US008002296B2

(12) United States Patent
Meader

(10) Patent No.: US 8,002,296 B2
(45) Date of Patent: Aug. 23, 2011

(54) SKATE BOARD WITH WEAR RESISTING MEANS

(76) Inventor: Keith Meader, Bonville (AU)

( * ) Notice: Subject to any disclaimer, the term of this patent is extended or adjusted under 35 U.S.C. 154(b) by 687 days.

(21) Appl. No.: 10/493,019

(22) PCT Filed: Oct. 19, 2002

(86) PCT No.: PCT/AU02/01419

§ 371 (c)(1),
(2), (4) Date: Jan. 4, 2005

(87) PCT Pub. No.: WO03/033090

PCT Pub. Date: Apr. 24, 2003

(65) Prior Publication Data

US 2006/0091633 A1 May 4, 2006

(30) Foreign Application Priority Data

Oct. 19, 2001 (AU) ..... PR8386

(51) Int. Cl.
*A63C 17/14* (2006.01)

(52) U.S. Cl. ..... 280/87.042; 280/87.041

(58) Field of Classification Search ..... 280/87.042, 280/602, 87.041
See application file for complete search history.

(56) References Cited

U.S. PATENT DOCUMENTS

| | | | | |
|---|---|---|---|---|
| 3,300,226 | A * | 1/1967 | Reed, Jr. | 280/602 |
| 3,990,713 | A * | 11/1976 | Hokanson | 280/87.042 |
| 3,995,873 | A | 12/1976 | Pantzar | |
| 4,034,995 | A | 7/1977 | Forward et al. | |
| 4,061,350 | A | 12/1977 | Schmidt, Jr. et al. | |
| 4,071,264 | A * | 1/1978 | Legrand et al. | 280/610 |
| 4,138,127 | A | 2/1979 | Kimmell et al. | |
| 4,140,326 | A * | 2/1979 | Huber | 280/87.042 |
| 4,161,326 | A * | 7/1979 | Gaber | 280/87.042 |
| 4,168,842 | A | 9/1979 | Kimmell et al. | |
| 4,199,165 | A * | 4/1980 | Spitzke | 280/87.042 |
| 4,202,558 | A | 5/1980 | Olschewski et al. | |
| 4,214,768 | A * | 7/1980 | Dominy et al. | 280/809 |
| 4,221,400 | A * | 9/1980 | Powers | 280/602 |
| 5,393,085 | A * | 2/1995 | Forneri | 280/602 |
| 6,036,218 | A | 3/2000 | Muff, Jr. | |
| D437,019 | S * | 1/2001 | Colon | D21/771 |
| 6,203,037 | B1 * | 3/2001 | Wilson et al. | 280/87.042 |
| 6,273,440 | B1 * | 8/2001 | Wilson | 280/87.042 |
| 6,386,561 | B1 | 5/2002 | Hanson | |
| 6,565,104 | B1 * | 5/2003 | Colon | 280/87.042 |
| 6,648,345 | B2 * | 11/2003 | Lee | 280/11.27 |
| 6,886,848 | B2 * | 5/2005 | Riepler | 280/602 |
| 6,945,542 | B2 * | 9/2005 | Stewart | 280/11.27 |
| 7,007,977 | B1 * | 3/2006 | Gallagher | 280/809 |
| 2005/0206128 | A1 * | 9/2005 | Gignoux | 280/602 |
| 2005/0230931 | A1 * | 10/2005 | Chen | 280/87.042 |
| 2005/0280235 | A1 * | 12/2005 | Colon | 280/87.042 |

FOREIGN PATENT DOCUMENTS

| | | |
|---|---|---|
| FR | 2 638 374 A1 | 5/1990 |
| GB | 2 346 561 A | 2/1999 |

* cited by examiner

*Primary Examiner* — Jeffrey J Restifo
(74) *Attorney, Agent, or Firm* — Stites & Harbison PLLC; Douglas E. Jackson

(57) ABSTRACT

A skate board (1) of the type including a riding platform (2) having a leading end and a trailing end and an undercarriage (3) formed by front and rear bogies which support said platform; wherein the platform and undercarriage mutually co-operate to allow relative movement. The platform has a peripheral edge (5) in which there is/are embedded a wear means (4); wherein, the wear means provides reinforcing and contributes to wear resistance of said surface of said platform.

26 Claims, 4 Drawing Sheets

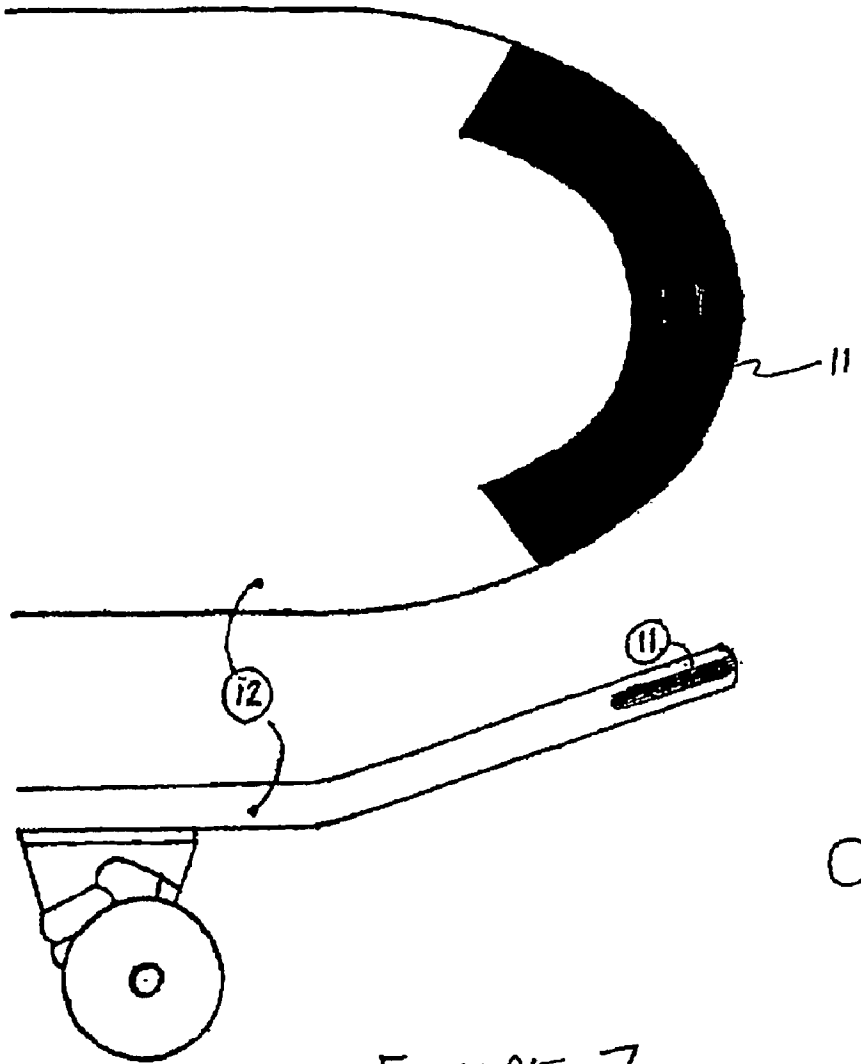
FIGURE 8
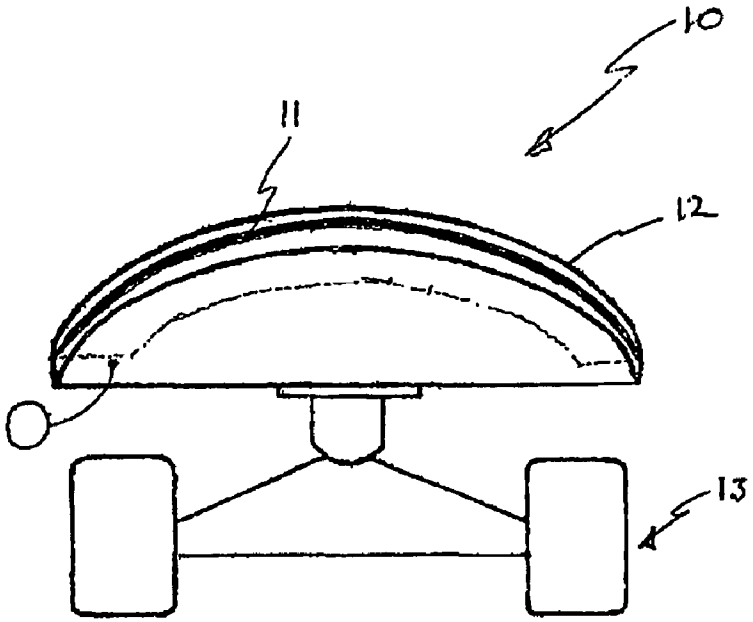
FIGURE 6
FIGURE 7

SKATE BOARD WITH WEAR RESISTING MEANS

BACKGROUND

The present invention relates to skateboards, and more particularly to a skateboard having integral reinforcing for providing wear means including reinforcing rods, wear layer/s or wear strips increasing wear resistance.

PRIOR ART

A skateboard is, essentially an enlarged roller skate including rubber or plastic bushes arranged within under carriage assemblies which support a platform on which a rider stands. The carriage assemblies absorb destabilising moments arising from their pivoting geometry. The bushes hold their respective carriages firmly about a central position thereby providing resistance to lateral tilting of the platform. Each carriage comprises a single pair of rollers attached to the underside of the support platform for supporting the user standing on the platform.

Skateboarding has been popular since its inception in the 1950's. Skate boards derived from roller skates and although there have been some modifications over the years the basic design has not changed significantly. A skateboard is controlled by the lateral tilting of its foot platform with responsiveness and manoeuvrability depending upon stiffness in the carriages' pivoting capabilities. The ability of the rider to tilt is essential to the operation of a skateboard. Skate boarding initially began as a child's recreational activity, but is now a serious competitive sport and in some cases an extreme sport with related acrobatic exhibitions and artistic performances. Proficiency on a skate board is measured by the skaters ability to change his position on the skate board, vary his footwork and contacts with various parts of the board. When performing acrobatics, the board edges may be subject to frictional wear due to ground engagement of edge surfaces particularly when the board is used in turning jumping and aerial manouvers which cause abrasive engagement between an edge of the board and a ground or wall surface. A user may be forced to grab both ends of the platform with his hands when airborne to maintain foot contact but this can cause board edges to engage the ground on the way back down causing accelerated wear.

Improvements in skate boards have over the years been directed to a variety of aspects of construction as well as function. Some improvements are identified below and relate to the boards themselves, as illustrated by U.S. Pat. No. 4,061,350 to Schmidt, Jr. et al which provides a modular wheel assembly construction that is designed for easier attachment to the underside of the skate board. Other teachings relate to suspension arrangements associated with wheels or rollers for the skating devices, as for example the structure shown in U.S. Pat. No. 4,202,558 in which there is shown an elastic support member for rollers of skating devices wherein each support member includes a pin element extending at an acute angle downwardly from the mounting plate in a bore in the support member in such a manner that one end of the pin engages against the shaft of the roller and retains it in the bore. Other improvements relate to the manner in which the wheels or rollers are supported to the board, as described in U.S. Pat. No. 4,138,127 which discloses a two wheel roller skate in which the two wheels rotate about parallel axes and are each supported in a cradle for rotation about an axis normal to the parallel axes. U.S. Pat. No. 4,168,842 discloses an undercarriage configuration for skate boards. Still other improvements relate to the wheel structure, as evidenced by U.S. Pat. No. 4,034,995 which shows a skate board including a boot having forward and rearward hollow spheroidal rollers in lieu of wheels.

One of the more significant problem areas encountered in the use of skate boards is excessive wear of the edges of a board thereby decreasing its effectiveness and working life. Steering of a board may be accomplished by the shifting of the weight of the rider to one side of the of the board or the other side. This could result in the edges touching abrasive ground surfaces. Each of the front and rear roller assemblies in conventional skate boards are mounted in mirror image relation to one another to permit the two pairs of wheels to turn simultaneously.

Developments in skate boards have concentrated on the undercarriage but there has been very little attention paid to the reduction in wear of surfaces. U.S. Pat. No. 3,995,873 to Pantzer discloses a two roller skateboard having a flat board with a pair of steerable rollers disposed about an underside thereof. Each of the two rollers are of substantial width, on the order of about one half of the overall width of the skateboard. Each roller is rotatably supported to the underside of the board in a manner to permit swivelling about a journal axis. The wider pair of roller offers stability to the rider at slower speeds and when the board is at rest; however, the Pantzer skateboard is still unstable and susceptible to tilting over during use because, although being wider than most wheels found in conventional skate boards, the limited width of the rollers contributes to board imbalance and this could lead to accelerated platform wear.

The known skate boards are prone to wear at the edges due to the rough manner of use particularly when the boards are used in skate board bowls in extreme sport. A typical known board may include heel guides proximate the position of the operator's feet for helping maintain the operator's feet inboard of the skate-board. Skate boards are generally used for level skating on a surface such as a road or footpath. They may also be used for the more daring rider for jumping steps, negotiating inclines and turning in mid air. Also, users often tilt the boards for braking purposes by engagement between the rear edge and the ground surface. This causes excessive and accelerated wear on the riding platform shortening the life of the boards. Heavy usage in this way can result in a board life of only a few months. One solution to the problem of edge wear has been to adapt a barrier layer or cover over the parts of the riding platform prone to wear. This solution is cumbersome, costly and inefficient for the user as the use must constantly check the fit and integrity of the wear cover. Also, wear covers are prone to unwanted separation from the skate board which could present a potential danger to the rider. At present there is no efficient and effective means for preventing or at least reducing wear on a skate board riding platform particularly at the wear edges. There is a long felt want to provide a wear resistant edge on a skate board riding platform to increase the life of a board and generally to prevent degradation of the appearance of the skate board.

INVENTION

Against this background of technological development, the applicant has developed a means for enhancing wear and particularly edge wear of a riding platform. A preferred embodiment includes a board on which a user stands, and a pair of wheel members arranged in alignment to one another and attached to the underside of the board. Preferably, the riding platform includes wear means which may comprise at least one reinforcing rod, layer or strip embedded in the rider platform.

It is an object of the present invention to provide a novel construction for a personal recreational device of the type on which a user stands and which is outfitted with rollers pivotably supported relative to the device that permit rolling motion of the device which is controlled by the user, and which will overcome many of the wear disadvantages and drawbacks of similar devices known in the art.

The present invention provides a skate board having a riding board mounted on wheel carriages and having a cross-section that is curved to be ergonomically advantageous for the user. More particularly according to one embodiment, the invention provides a skate board which has a reinforced riding board in which pins are inserted at least about a rear edge of the board thereby providing a reinforced wear surface. The board typically includes two sets of undercarriages In one broad form the present invention comprises:

a skate board having;

a riding platform for supporting a rider and including a front end projecting nose and trailing end section;

rear and front wheel carriages mounted under said leading and trailing end sections of said board, the front and rear carriages each having a pair of front wheels attached by a pair of front legs diverging and extending downwardly and rearwardly from a support, characterised in that the riding platform includes along at least a part of the platform edge at least one reinforcing means.

Preferably, the platform includes a plurality of reinforcing rods embedded in said at least part of said edge so that they terminate flush with an outer surface of said platform. Alternatively the platform reinforcing means comprises a wear layer embedded in the platform. In a further alternative the ear means comprises a wear strip embedded in the platform.

According to a preferred embodiment, the skate board platform receives a plurality of spaced apart reinforcing rods disposed in an arc about the trailing end of the skate board.

In its broadest form the present invention comprises:

a skate board of the type including a riding platform having a leading end and a trailing end and an undercarriage formed by front and rear bogies which support said platform; wherein the platform and undercarriage mutually co operate to allow relative movement;

characterised in that the platform has a peripheral edge in which there is/are embedded a wear means; wherein, the wear means provides reinforcing and contributes to wear resistance of said surface of said platform.

In one broad form of a method aspect the present invention comprises:

method for reduction of wear in a rider platform of a skate board in which the rider platform is mounted on an undercarriage, wherein the method comprises the steps of;

a) constructing the riding platform for the skate board from a single layer of material;

b) taking at least one reinforcing rod or pin and inserting the at least one pin into the riding platform at a site of expected wear in the platform;

c) placing said at least one reinforcing rod or pin in said platform so that the rod or pin is capable of engagement with a wear inducing surface during use to prevent or reduce wear of the rider platform.

In another broad form of a method aspect the present invention comprises:

a method for reduction of wear in a rider platform of a skate board in which the rider platform is mounted on an undercarriage, wherein the method comprises the steps of;

a) constructing the riding platform for the skate board from laminated layers of material;

b) taking at least one reinforcing rod or pin and inserting the at least one pin into the riding platform at a site of expected wear;

c) placing said at least one reinforcing rod or pin in said platform so that the rod or pin is capable of engagement with a wear inducing surface during use to prevent or reduce wear of the rider platform.

In another broad form of a method aspect the present invention comprises:

a method for reduction of wear in a rider platform of a skate board in which the rider platform is mounted on an undercarriage, wherein the method comprises the steps of;

a) constructing the riding platform for the skate board from a single layer of material;

b) taking at least one reinforcing strip, inserting the at least one strip into the riding platform at a site of expected wear;

c) placing said at least one reinforcing strip in said platform so that the strip is capable of engagement with a wear inducing surface during use to prevent or reduce wear of the rider platform.

In another broad form of a method aspect the present invention comprises:

a method for reduction of wear in a rider platform of a skate board in which the rider platform is mounted on an undercarriage, wherein the method comprises the steps of;

a) constructing the riding platform for the skate board from laminated layers of material;

b) providing at least one of the laminated layers as a wear layer to provide wear resistance at a site of expected wear;

c) placing said wear layer so that the layer is capable of engagement with a wear inducing surface during use to prevent or reduce wear of the rider platform.

In another broad form the present invention comprises:

a kit for use in reinforcing against wear a skate board of the type including a riding platform having a leading end and a trailing end and an undercarriage formed by front and rear bogies which support said platform; wherein the platform and undercarriage mutually co operate to allow relative movement between the platform and carriages;

wherein the kit comprises rods or pins for insertion into said platform at a site of anticipated wear of the riding platform.

Preferably, the kit includes a resin or glue for fixing said rods or pins into holes in the platform, wherein the rods/pins provide reinforcing and contribute to or prevent wear of said surface of said platform.

The kit preferably includes a template which allows accurate location of said predrilled holes.

DETAILED DESCRIPTION

The present invention will now be described in more detail according to a preferred embodiment and with reference to the accompanying illustrations, wherein FIG. 1 shows a perspective view of a skate board with a reinforcing pins/rods according to one embodiment;

FIG. 6 shows a rear perspective view of a skate board with a wear layer according to one embodiment;

FIG. 7 shows a side elevation of the skate board of figure with wear layer;

FIG. 8 shows a plan view of FIG. 6;

According to one embodiment of the invention as described with reference to FIGS. 1-5, there is provided a skate board which includes wear resistant elements which may be pins, metal rods or the like inserted in a region of the board at or near a wear edge. A wear edge is likely to be at the rear of the board. Although it will be appreciated by persons skilled in the art that the pins, metal rods or the like may be inserted into the edges of the board at any angle and at any location preferably extending from an edge of the board, the present invention will be described primarily with reference to insertion of the reinforcing towards the trailing end of the board. The reinforcing may be inserted at an angle relative to the edge of the board but the optimal orientation of the reinforcing will be substantially normal relative to the surface causing the wear such as a ground surface. Thus the orientation of the reinforcing may be at almost any angle relative to the edge of the riding platform depending upon the predicted point of contact with the ground surface.

Figures 1, 2, 3:
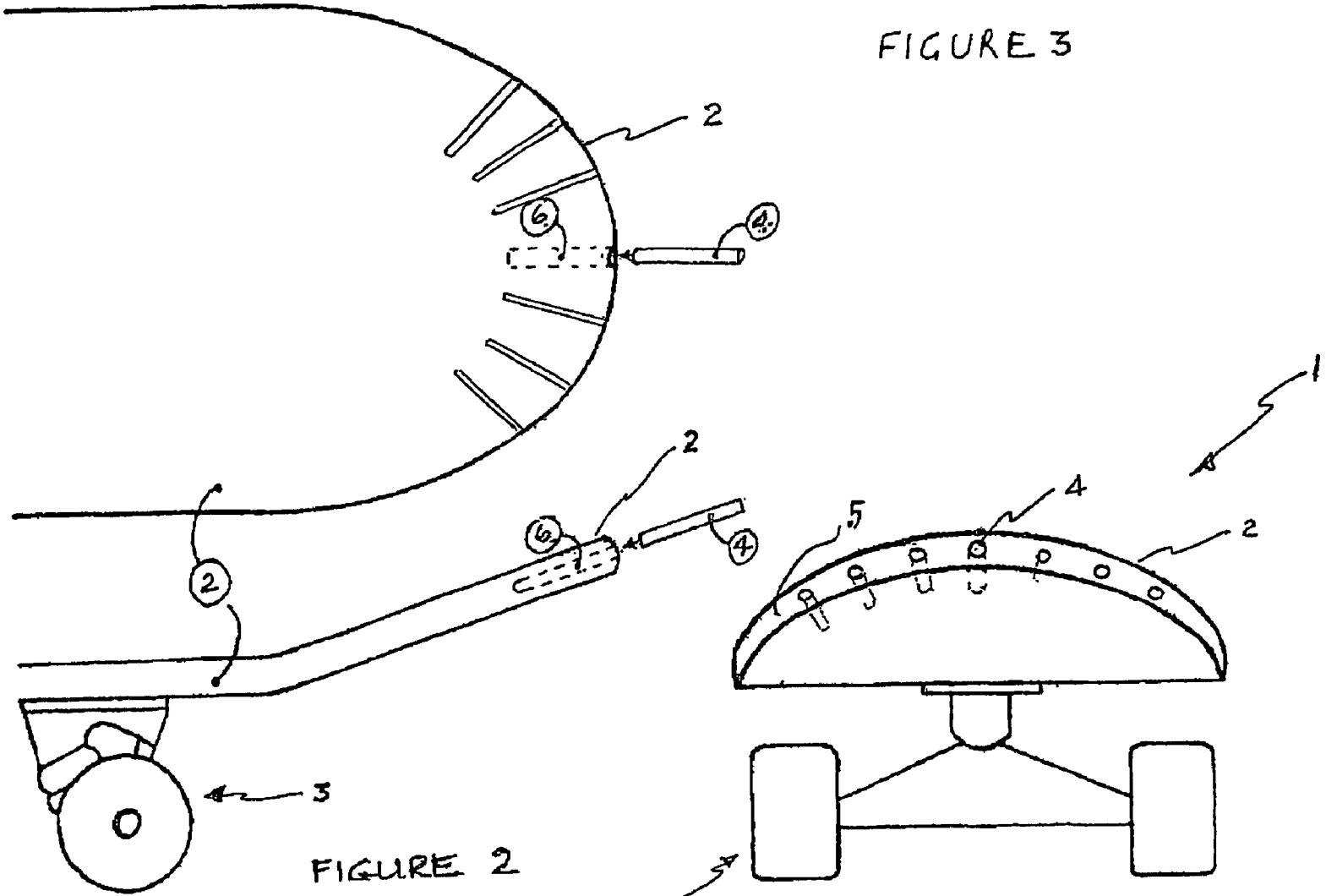
FIG. 2 shows a side elevation of the skate board of FIG. 1 with one reinforcing pin/rod exploded from the platform.
FIG. 3 shows a plan view of FIG. 2.

Referring to FIG. 1 there is shown a perspective view of a skate board 1 including a riding platform 2 mounted on undercarriage assembly 3. Platform 3 includes an array of rods or pins 4 which are embedded via edge 5 of platform 3.

Figure 4:
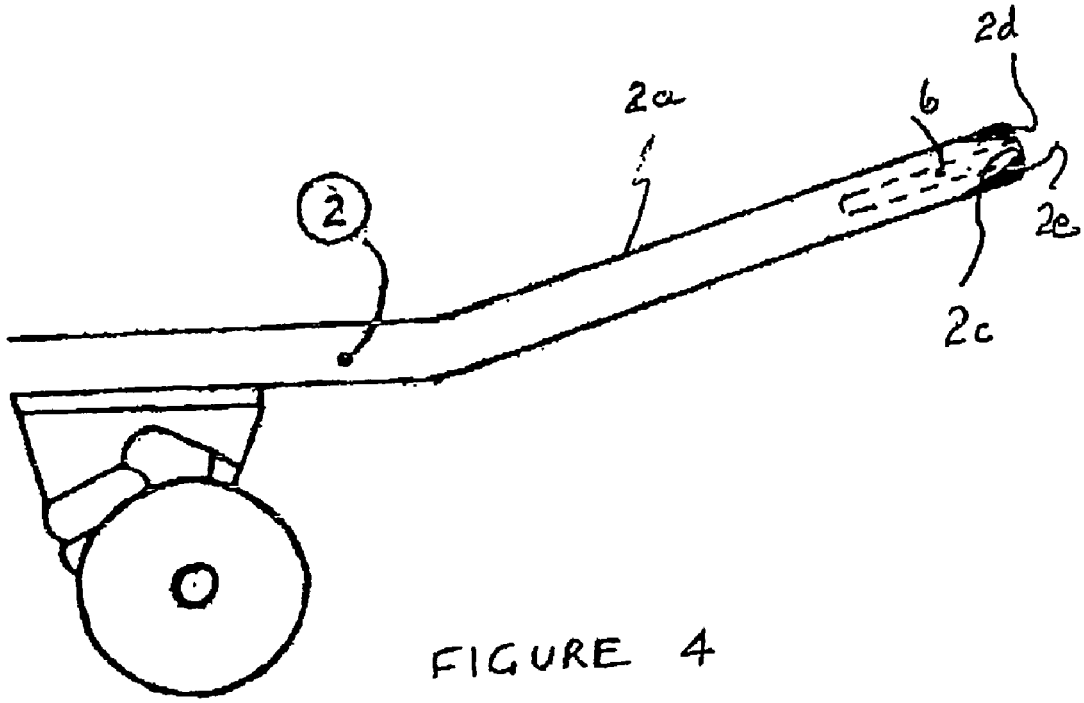
FIG. 4 shows a side elevation of a rear portion of a skate board with reinforcing pin exploded according to a preferred embodiment.
Figure 5:
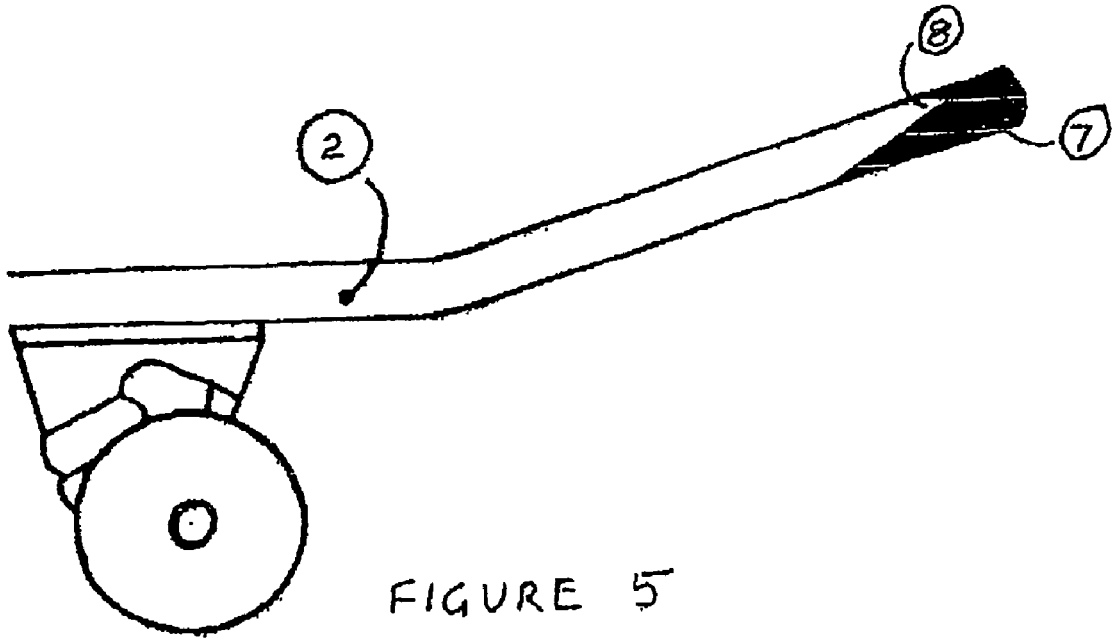
FIG. 5 shows a side elevation of a skate board including a rear end wear region.

FIG. 2 shows a side elevation of the skate board of FIG. 1 with one reinforcing pin/rod 4 exploded from platform 2 leaving channel 6;

FIG. 3 shows a plan view of FIG. 2. The number of rods may be varied according to specific wear resistance requirements. Accordingly, if concentrated wear is anticipated then one rod may suffice at the site of anticipated wear. On the other hand if more wide spread wear is anticipated, the rods may be distributed as shown in FIGS. 1-3. FIG. 4 shows a side elevation of a rear portion of the skate board 1 of FIG. 1 with reinforcing pin 4 removed leaving channel 6. Platform 2 includes inclined portion 2*a* which terminates at edge 2*c*. Edge 2*c* is prone to abrasive wear at darkened regions 2*d* and 2*e*. FIG. 5 shows a side elevation of the skate board 1 including a darkened region 7 which demonstrates a typical wear pattern which can lead to a sharp chiselled edge 8.

Preferably, the reinforcing rods are disposed at the trailing end of the platform and are embedded in the surface so that an end of said reinforcing rods are flush with the surface. The rods are preferably disposed normally to an outer surface of the riding platform disposed at an angle relative to an edge of said board so that when in situ an end each said rods engage normally to the surface causing wear such as a ground surface. The reinforcing rods when viewed in cross section may be, triangular, square, circular, ovoid, polygonal, diamond shaped or rectangular and may be detachable from the platform.

According to one embodiment, the pins/rods are cylindrical and are embedded to a depth within the range of 3 mm to 25 mm from an edge of the board. The ros may be made from a metal such as but not limited to stainless steel titanium, hardened plastic material or hard compound rubber.

FIG. 6 shows a rear view of a skate board 10 with a wear layer 11 according to one embodiment. Skate board 10 includes a riding platform 12 mounted on undercarriage assembly 13. Platform 12 includes wear layer embedded in laminated layers of platform 12 during manufacture of platform 12. This layer may be disposed over the full length of the platform 12 or may be abbreviated as shown. Alternatively, the wear layer may be inserted in a preformed groove in platform 12. FIG. 7 shows a side elevation of the skate board 10 of FIG. 6.

Figures 9, 10, 11:
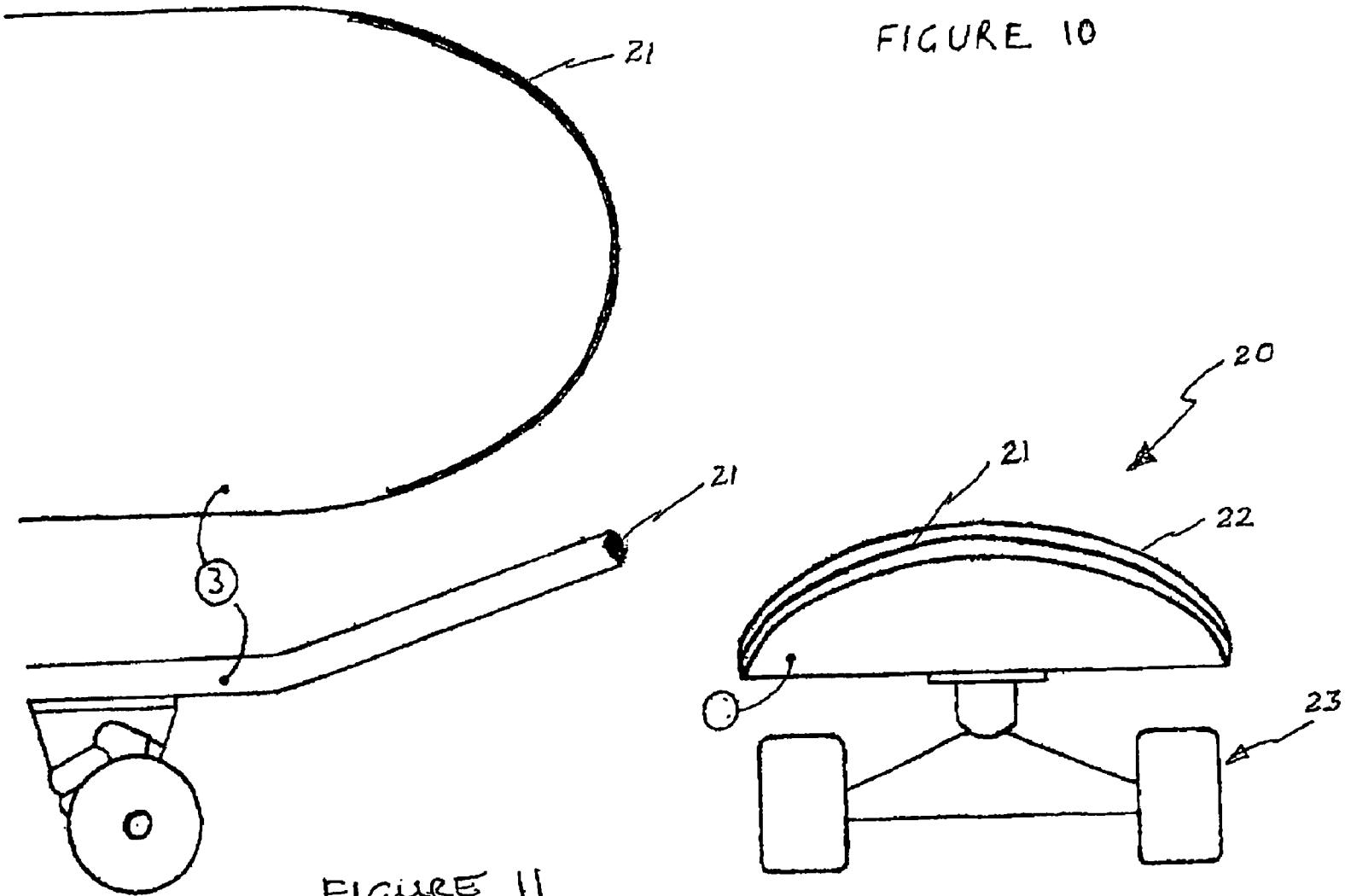
FIG. 9 shows a rear perspective view of a skate board with a reinforcing strip according to one embodiment.
FIG. 10 shows a side elevation of the skate board of FIG. 1 with reinforcing strip.
FIG. 11 shows a plan view of FIG. 9.

FIG. 9 shows a rear view of a skate board 20 with a wear layer 21 according to one embodiment Skate board 20 includes a riding platform 22 mounted on undercarriage assembly 23. Platform 22 includes reinforcing wear strip embedded in platform 22 during manufacture. This strip may be disposed over the full length of the platform 22 or may be abbreviated as shown. Alternatively, the strip may be inserted in a preformed groove in platform 22. FIG. 10 shows a side elevation of the skate board 20 of FIG. 9.

FIG. 11 shows a plan view of FIG. 9. If concentrated wear is anticipated then wear strip may be inserted about the full periphery of the skate board.

According to the method aspect when rods/pins are used for reinforcing holes pre drilled into the edge of the platform whereupon the pins are inserted. The diameter of the holes is slightly larger than the diameter of the pins so as to accommodate glue or resin used to secure the pins within the holes. When riding the board a tolerable amount of wear takes place as shown by numerals 2*d* and 2*e* of FIG. 4. The rods resist further unwanted wear as the rods and pins engage a wear inducing surface. The rods are also useful in absorbing impact damage to the platform and distributing the shock over the board and reducing concentrations of load on otherwise weak cantilevered parts of the platform. In the absence of the rods or pins the wear pattern would be as shown in FIG. 5 where the extremity of the platform is chiselled as indicated by numeral 8.

In the case of the wear layer, this may be inserted during lamination of the platform where this is formed from layers. Where the platform is solid a wear strip may be employed at the edges of the board and this would preferably conform to the contour of the platform profile but may be any practical shape.

It will be recognised by persons skilled in the art that numerous variations and modifications may be made to the invention as broadly described herein without departing from the spirit and scope of the invention.

The invention claimed is:

1. A skate board of the type including a riding platform having a leading end and a trailing end and an undercarriage formed by front and rear bogies which support said platform;

wherein the platform and undercarriage mutually co-operate to allow riding on the platform while the undercarriage travels along a ground surface;

wherein the platform has an upper surface, a lower surface and a wear means embedded in the platform between said upper and lower surfaces at or near a peripheral end edge for providing resistance to edge wear of said peripheral end edge of said platform caused by abrasion of the peripheral end edge and of the wear means when the peripheral end edge and said wear means together engage an abrasive ground or wall surface during use of the board;

wherein said wear means are embedded rods which are disposed about the trailing end of the platform so that an end of said rods provides wear resistance when said rod ends are flush with the peripheral end edge of the platform;

wherein the rods are disposed normally to an outer surface of the peripheral end edge of said platform; and wherein the rods are embedded in the platform no deeper than 3 mm to 25 mm and have a length no greater than a distance from the rear bogie to the peripheral rear end edge of the board.

2. A skate board according to claim 1 wherein the rods are releasable from the platform.

3. A skate board according to claim 2 wherein the reinforcing rods when viewed in cross section are circular.

4. A skate board according to claim 2 wherein the reinforcing rods are made from steel or stainless steel.

5. A skate board according to claim 2 wherein the wear means comprises a combination of at least one wear resisting rod and a wear strip.

6. A skate board according to claim 2 wherein the wear resisting rods when viewed in cross section are triangular.

7. A skate board according to claim 2 wherein the wear resisting rods when viewed in cross section are square.

8. A skate board according to claim 2 wherein the wear means comprises a combination of at least one wear resisting rod and a wear layer in said platform.

9. A skate board according to claim 8 wherein the wear means comprises a wear layer set into said platform between the upper and lower surfaces.

10. A skate board according to claim 9 wherein the wear layer is sandwiched between laminated layers which form said platform.

11. A skate board according to claim 10 wherein the wear layer is disposed across the full area of the platform or abbreviated at the rear of the platform.

12. A skate board according to claim 2 wherein the wear resisting rods when viewed in cross section are ovoid.

13. A skate board according to claim 2 wherein the wear resisting rods when viewed in cross section are polygonal.

14. A skate board according to claim 2 wherein the wear resisting rods when viewed in cross section are diamond shaped.

15. A skate board according to claim 2 wherein the wear resisting rods when viewed in cross section are rectangular.

16. A skate board according to claim 1 wherein the reinforcing rods are made from a material selected from metal, hardened plastic material or hard compound rubber.

17. A kit for use in reinforcing against wear a skate board of the type including a riding platform having a leading end and a trailing end and an undercarriage formed by front and rear bogies which support said platform;

wherein the platform and undercarriage mutually co-operate to allow relative movement between the platform and carriages;

wherein the kit comprises wear resisting rods for insertion into said platform at a site of anticipated wear at or near peripheral end edge of the riding platform so that the wear resisting rods engage a wear inducing surface together with the edge to reduce wear of the edge;

wherein the wear resisting rods when inserted into the platform are disposed normally to an outer surface of the peripheral end edge of said riding platform; and wherein the wear resisting rods are dimensioned so that when inserted in the platform the wear resisting rods are no deeper than 3 mm to 25 mm and have a length no greater than a distance from the adjacent bogie to the peripheral end edge of the board.

18. A kit according to claim 17 wherein the kit includes a resin or glue for fixing said wear resisting rods into holes predrilled into said platform.

19. A kit according to claim 18 wherein the kit includes a template which allows accurate location of said predrilled holes.

20. A kit according to claim 17 wherein the wear resisting rods when viewed in cross section are circular.

21. A kit according to claim 17 wherein the wear resisting rods when viewed in cross section are triangular.

22. A kit according to claim 17 wherein the wear resisting rods when viewed in cross section are square.

23. A kit according to claim 17 wherein the wear resisting rods when viewed in cross section are ovoid.

24. A kit according to claim 17 wherein the wear resisting rods when viewed in cross section are polygonal.

25. A kit according to claim 17 wherein the wear resisting rods when viewed in cross section are diamond shaped.

26. A kit according to claim 17 wherein the wear resisting rods when viewed in cross section are rectangular.

* * * * *